US010501989B1

(12) United States Patent
McDonough et al.

(10) Patent No.: US 10,501,989 B1
(45) Date of Patent: Dec. 10, 2019

(54) BUCKET HOLDER FOR EXTENSION AND STEP LADDERS

(71) Applicant: Kelly J. McDonough, Boyne City, MI (US)

(72) Inventors: Kelly J. McDonough, Boyne City, MI (US); Daniel J. Stowell, Boyne City, MI (US); Joel Robinson, Charlevoix, MI (US)

(73) Assignee: Kelly J. McDonough, Boyne City, MI (US)

( * ) Notice: Subject to any disclaimer, the term of this patent is extended or adjusted under 35 U.S.C. 154(b) by 0 days.

(21) Appl. No.: 16/053,476

(22) Filed: Aug. 2, 2018

Related U.S. Application Data

(60) Provisional application No. 62/540,946, filed on Aug. 3, 2017.

(51) Int. Cl.
*E06C 7/14* (2006.01)

(52) U.S. Cl.
CPC ..... *E06C 7/14* (2013.01); *E06C 7/143* (2013.01)

(58) Field of Classification Search
CPC ..... E06C 7/14; E06C 7/143; E06C 7/165
USPC ..... 248/210, 211, 238; 182/128, 129
See application file for complete search history.

(56) References Cited

U.S. PATENT DOCUMENTS 2,686,033 A * 8/1954 Keiter ..... E06C 7/14 248/211
2,880,953 A 4/1959 Dicks
2,950,080 A * 8/1960 Clifford ..... E06C 7/14 248/210
3,051,428 A * 8/1962 Schult ..... E06C 7/146 220/743
4,016,955 A 4/1977 Gates
4,445,659 A 5/1984 LaChance
4,574,534 A * 3/1986 Beaton ..... E04G 21/28 182/129
4,660,794 A * 4/1987 Given ..... E06C 7/188 182/120
4,662,594 A * 5/1987 Dubis ..... E06C 7/143 248/231.21
4,824,060 A 4/1989 Korda
5,031,723 A * 7/1991 Hooten ..... E06C 1/38 182/120
5,135,193 A * 8/1992 Parris ..... E06C 7/143 182/129
5,181,682 A * 1/1993 Indelicato ..... E06C 7/143 248/210
5,293,957 A 3/1994 Lunden, Jr.
5,316,251 A 5/1994 McGraw
5,649,682 A 7/1997 Martin
5,687,941 A 11/1997 Quintile
5,934,632 A * 8/1999 Weaver ..... E06C 7/143 182/129
5,960,905 A 10/1999 Gardner
(Continued)

*Primary Examiner* — Nkeisha Smith

(74) *Attorney, Agent, or Firm* — Northern Michigan Patent Law, PLC

(57) ABSTRACT

A bucket holder for securing a paint bucket or the like to a side of an extension ladder and to the top step of step ladder. The bucket holder comprises a bucket support defining an opening for a bucket, the bucket support having an inner ladder-engaging side with a three-pronged rung attachment fork and an outer side with a downwardly extending grip that doubles as a step ladder attachment.

6 Claims, 5 Drawing Sheets

(56) References Cited

U.S. PATENT DOCUMENTS

| | | | | |
|---|---|---|---|---|
| 5,971,103 | A * | 10/1999 | Mulvaney | E06C 7/143 182/129 |
| 6,076,636 | A * | 6/2000 | Tietge | E06C 7/143 182/129 |
| 6,241,204 | B1 | 6/2001 | Bermes | |
| 6,254,045 | B1 | 7/2001 | Oatsvall | |
| 6,260,663 | B1 | 7/2001 | Combs | |
| 6,338,459 | B1 | 1/2002 | Biggs | |
| 6,352,135 | B1 * | 3/2002 | Jones | E06C 7/143 182/120 |
| 7,063,187 | B1 * | 6/2006 | Lavigne | E06C 1/39 182/129 |
| 7,178,633 | B2 * | 2/2007 | Angotti | E06C 7/14 182/129 |
| 7,607,623 | B2 | 10/2009 | Wesolowski | |
| 7,926,616 | B2 * | 4/2011 | Groy | E06C 7/14 182/129 |
| 7,967,264 | B1 * | 6/2011 | Peterson | E06C 7/143 182/115 |
| 2006/0192063 | A1 * | 8/2006 | Angotti | E06C 7/14 248/210 |
| 2007/0221802 | A1 * | 9/2007 | New, Sr. | E06C 7/143 248/210 |
| 2007/0228237 | A1 * | 10/2007 | Pochurek | E06C 7/143 248/210 |
| 2008/0061201 | A1 * | 3/2008 | Sasser | E06C 7/14 248/210 |
| 2008/0149793 | A1 | 6/2008 | Wesolowski | |
| 2011/0168493 | A1 | 7/2011 | Clark | |
| 2013/0200230 | A1 | 8/2013 | Christiansen | |
| 2014/0353446 | A1 | 12/2014 | Walters | |

* cited by examiner

BUCKET HOLDER FOR EXTENSION AND STEP LADDERS

RELATED APPLICATIONS/PRIORITY BENEFIT CLAIM

This application claims the benefit of U.S. Provisional Application No. 62/540,946, filed Aug. 3, 2017 by common inventors (McDonough and Stowell), the entirety of which provisional application is hereby incorporated by reference.

FIELD

The subject matter of the present application is in the field of devices for securing paint buckets and similar to ladders.

BACKGROUND

Bucket holders, paint can holders, and paint tray holders (hereafter generally "bucket" holders) designed to be attached to ladders to securely hold paint and similar fluids are known, and are especially useful for painters who need a bucket or tray of paint securely held while up a ladder.

Bucket holders adapted to be attached to the uppermost platform or "step" on a step ladder are known. Examples include those shown in U.S. Pat. No. 2,880,953 to Dicks (bucket or paint can holder with cage-like construction for attaching to ladder step or other flat supporting structure); and U.S. Pub. App. No. 2013/0200230 A1 to Christiansen (adjustable step ladder paint bucket holder incorporating a support plate with an angled grasping flange secured to step ladder top step).

Bucket holders configured to be attached to an extension ladder are also known, in which a rod-like arm is inserted into the open end of one of the hollow rungs exposed on the side rails of the ladder. Examples include those shown in U.S. Pat. No. 4,445,659 to LaChance (combination bracket and adjustable ladder paint tray, with two spaced arms for insertion into two adjacent rungs); U.S. Pat. No. 5,971,103 to Mulvaney (paint can or bucket support with rotation adjustable D-shaped arm inserted in a rung, with a securing chain wrapped around the side rail of the ladder); and, U.S. Pub. App. No. 2007/0221802 A1 to New, Sr. et al. (tray assembly having a cylindrical paint well, with wedge rod for insertion in rung, and upper and lower braces with the upper brace having a carry handle function).

There remains a need for a bucket holder that is simple to make and to use, while at the same time providing a very secure platform for attachment to a ladder, in particular to an extension ladder.

BRIEF SUMMARY

The invention is a bucket holder configured for attachment to both extension and step ladders. The inventive bucket holder comprises a horizontal support for a bucket, paint can, or similar (hereafter generally "bucket"), the support having an inner side and an opposite outer side. A three-pronged rung attachment fork extends from the inner side of the bucket support, the fork comprising a longer middle prong and two shorter outer prongs, and the fork being rotationally adjustable relative to the bucket support between a plurality of rotationally locked positions. The longer middle prong is sufficiently long to extend into a hollow rung through the side rail of a ladder; the outer prongs are spaced apart a distance wider than the width of an extension ladder side rail in order to bracket the side rail when the middle prong is inserted in a rung of the ladder, and short enough not to extend inwardly beyond the inner edge or side of the ladder side rail.

In a further form, a handle extends outwardly from the outer side of the bucket support, with a grip portion spaced laterally and extending downwardly from the bucket support. In a preferred form, the handle has an upside down L-shape with a generally right angle between an outward stem portion and a vertically downward grip portion.

In yet a further form, a stabilizer bracket is associated with the outer side of the bucket support between the bucket support and the grip portion, the bracket configured to engage the edge of a step ladder's top shelf or step to prevent rocking.

In a further form, the bucket support comprises a substantially enclosed planar support frame or ring with an opening for a bucket or similar container therethrough, and the rung attachment fork comprises a three-pronged fork. In one form the rung attachment fork is a three-pronged planar fork with at least one position generally coplanar with the support ring. In another form the rung attachment fork comprises two outer prongs in a plane offset from the center prong and the plane of the support ring.

"Extension" ladder will be used herein to include any ladder with a side rail having hollow rungs with open ends exposed along a side rail portion of the ladder, whether or not the ladder has multiple sections capable of being extended relative to one another.

These and other features and advantages of the invention will become apparent from the detailed description below, in light of the accompanying drawings.

DETAILED DESCRIPTION

Figure 1:
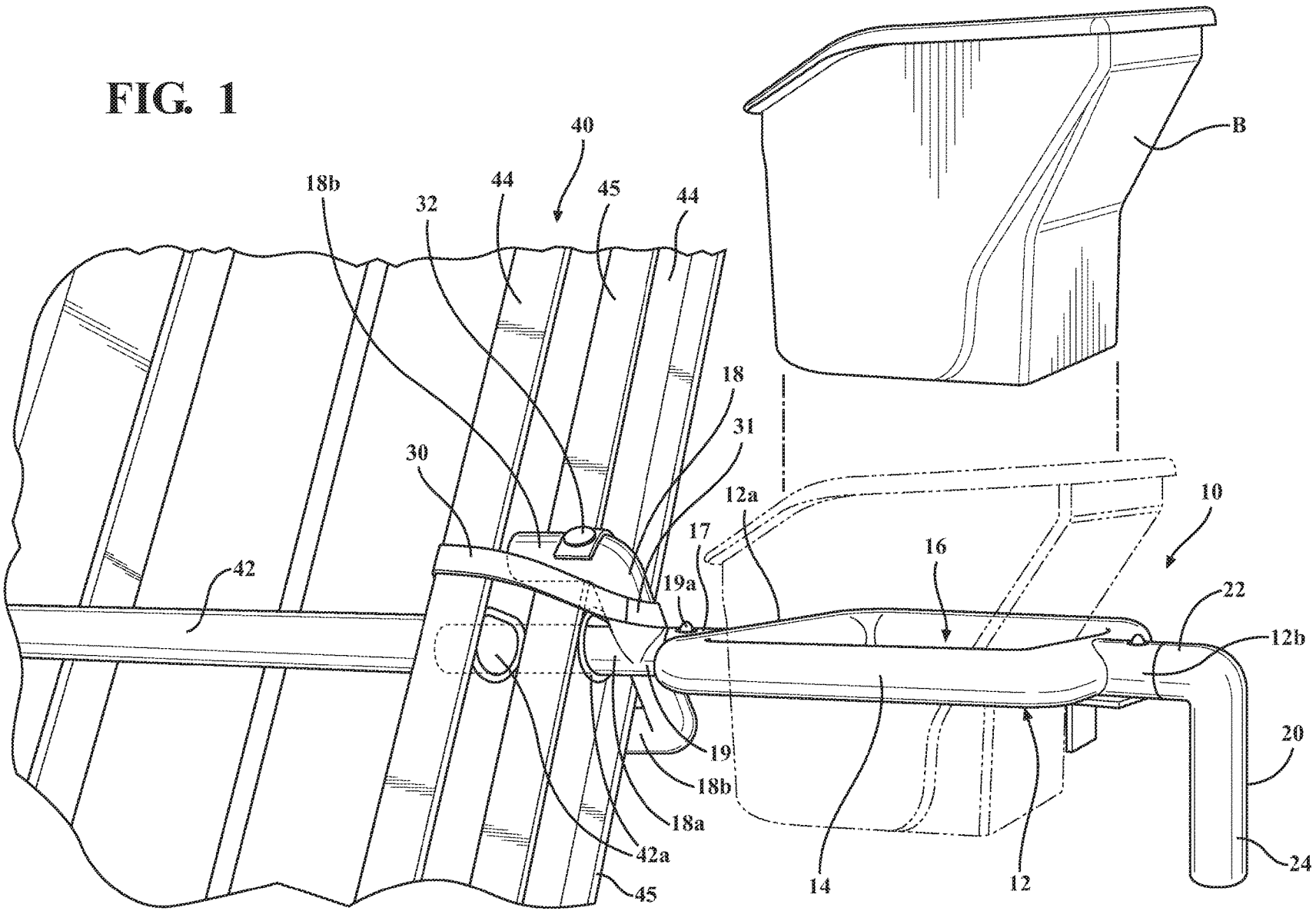
FIG. 1 is a perspective view of a bucket holder according to the invention, exploded from the rung of a ladder.

Referring first to FIG. 1, a bucket holder 10 is shown in exemplary form in order to teach how to make and use the claimed invention. Bucket holder 10 comprises a bucket support 12, in the illustrated example an open frame defining a substantially enclosed rectangle with a tubular outer rectangular ring 14 and an open interior 16 sized and shaped to receive a common type of rectangular paint bucket B partway therethrough and to hold bucket B securely. Bucket support frame 12 may take other shapes than rectangular, depending on the shape of the container intended to be held or supported; and may either fully or partially enclose the interior open area 16, depending on the strength of the material used, with fully enclosed as illustrated being preferred for strength and stability. The material used for support frame 12 may also vary, with the illustrated example being made from hollow plastic or metal tubing, e.g. PVC or aluminum, although the cross-sectional shape of the material does not have to be round, and it does not have to be hollow. Support frame 12 and the remainder of bucket holder 10 may be formed from a single piece of material, for example molded or cast as one piece, or it may comprise several separately formed pieces joined together either permanently or removably.

Support frame 12 has an inner side 12*a* and an outer side 12*b*. The inner side 12*a* is adapted to be engaged with an extension ladder 40 (FIGS. 1-3) having hollow rungs 42 whose open ends 42*a* are exposed on side rails 44. The outer side 12*b* includes a grip configured to engage a top shelf of a step ladder (FIG. 4).

Figure 2:
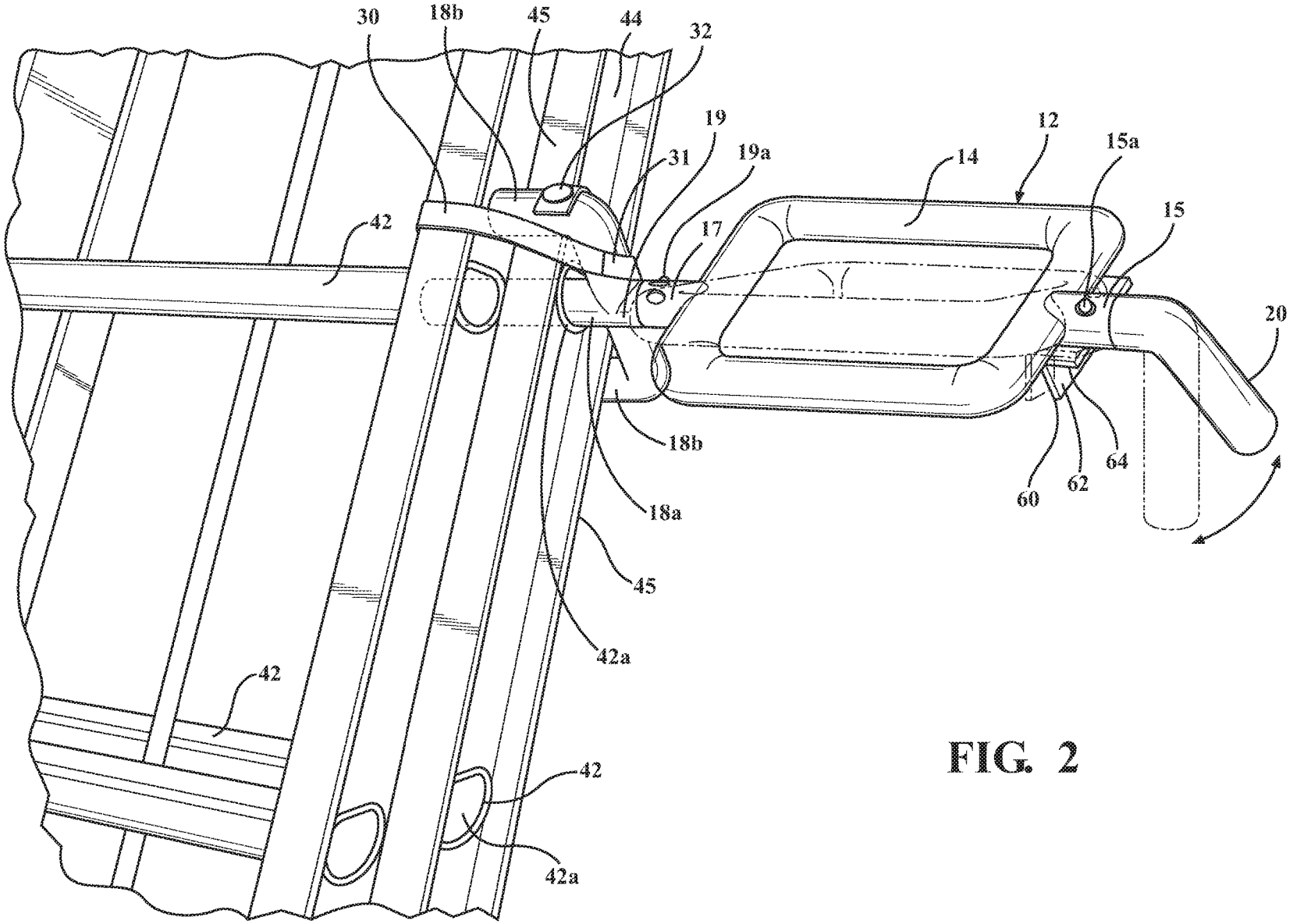
FIG. 2 is similar to FIG. 1, but shows the bucket holder connected to ladder.
Figure 3:
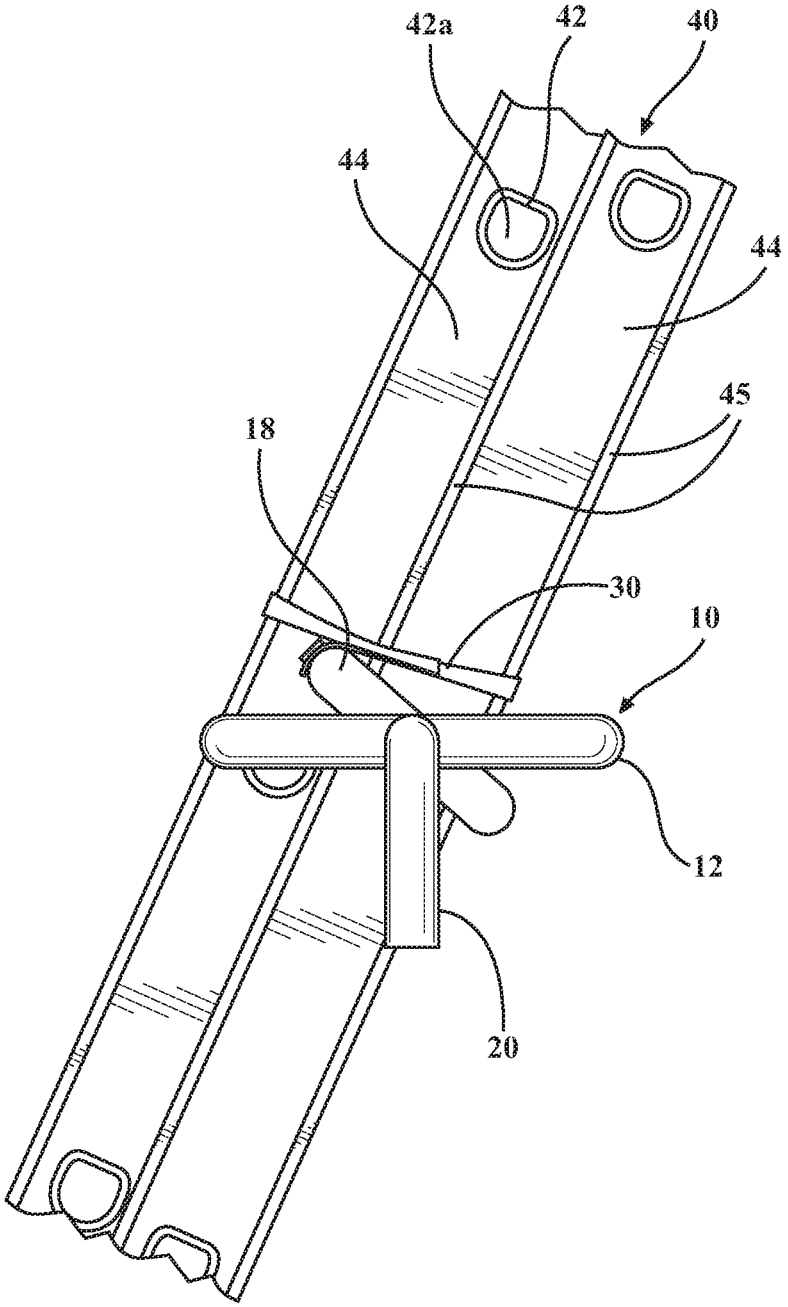
FIG. 3 is an outer end view of the bucket holder of FIG. 1, showing different rotational positions of the rung attachment fork relative to the bucket support frame.
Figure 4:
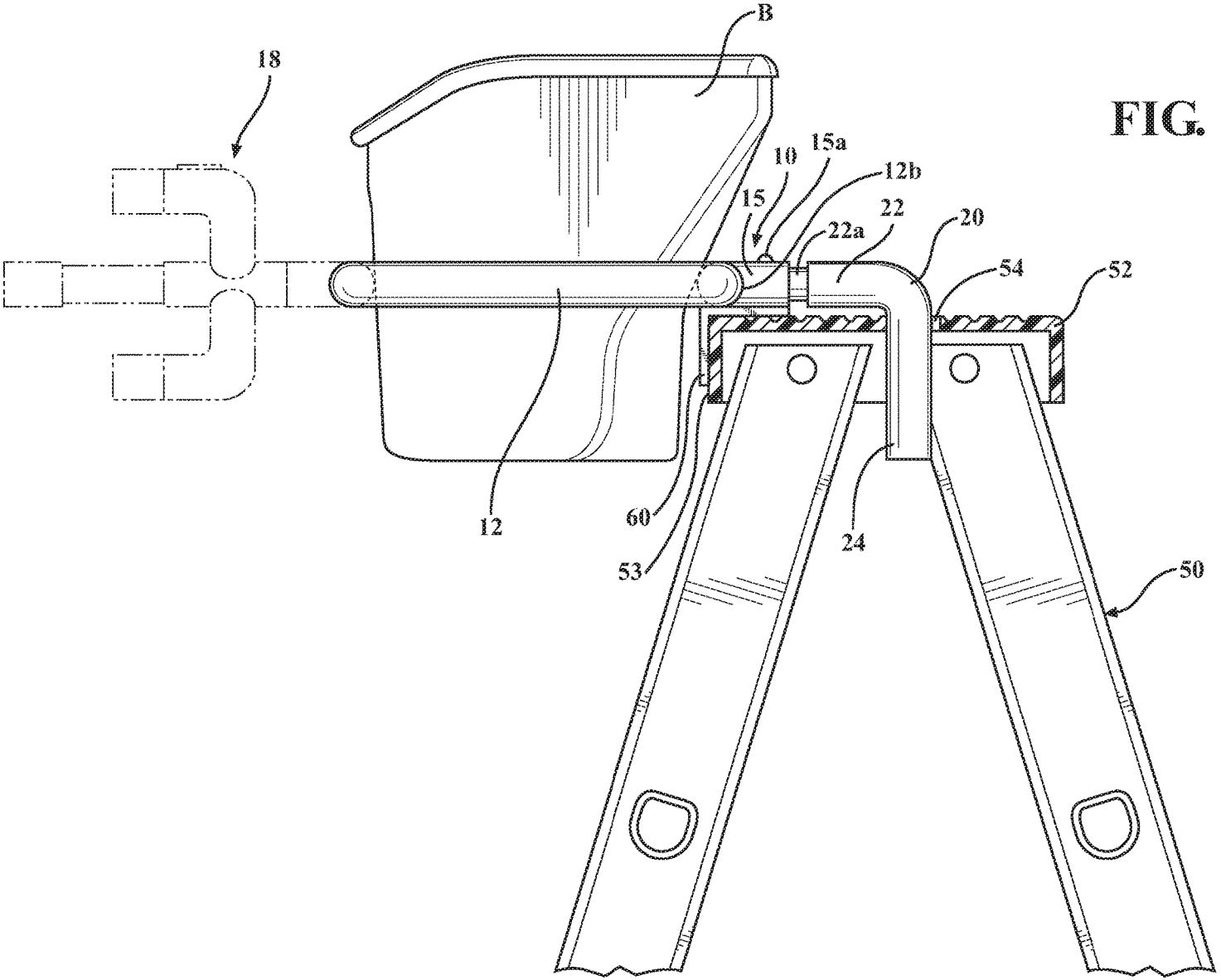
FIG. 4 is a side elevation view of the bucket holder of FIG. 1, with the grip handle inserted vertically into an opening in the upper shelf or step of a step ladder.

To engage an extension ladder such as that shown at 40 in FIGS. 1-3, the inner side 12*a* of support frame 12 includes a rung attachment fork 18 extending from the middle of the frame and defining a substantially planar three-pronged fork or trident, with a longer middle prong 18*a* and two shorter outer prongs 18*b*. Referring to FIGS. 1 and 2, middle prong 18*a* is inserted into the open end 42*a* of a hollow rung 42, and as the middle prong nears full insertion, the shorter outer prongs 18*b* extend over the front and rear edges 45 of the associated side rail 44.

The spacing between outer prongs 18*b* is chosen to be equal to or wider than the widest expected side rail encountered on a ladder, and may vary accordingly. However, in a preferred form, the distance between outer prongs 18*b* is greater than the side rail width, and rung attachment fork 18 is rotatably mounted on support frame 12 so that the outer prongs 18*b* may be rotated into contact with the front and rear edges 45 of side rail 44. In the illustrated example, rung attachment fork 18 is rotatably mounted on a cylindrical stem 17 extending outwardly from inner side 12*a* of support frame 12 via a mating cylindrical base or bushing 19, with a detent or locking pin 19*a* selectively engageable with aligned sets of holes formed around the circumference of stem 17 and bushing 19 to lock fork 18 at a selected rotational angle relative to the plane of support frame 12. It will be understood that other types of rotational connection and/or locking mechanism could be used, and that the illustrated detent pin arrangement is only a currently preferred example.

The opposite, outer side 12*b* of support frame 12 includes a handle 20. In the illustrated example, handle 20 comprises an upside-down L-shaped piece, for example formed from the same material as ring 16 in the support frame. Handle 20 includes a horizontal stem 22 spacing a vertically downward grip 24 away from the support frame a sufficient distance to provide finger room for a person using the grip to attach the holder to a ladder, or for carrying the holder while it contains a bucket of paint.

As best shown in FIGS. 1 and 2, once middle prong 18*a* is inserted in rung 42, and outer prongs 18*b* are rotated into contact with edges 45 of side rail 44 and then rotationally locked with detent/pin 19*a*, support frame 12 can be held in a horizontal position that keeps bucket B level. Bucket holder 10 can be additionally secured to ladder 10 with a strap, cord, or chain 30 secured, for example, to the outside edge of one of outer prongs 18*b* at 32. In the illustrated example, strap 30 is uses hook-and-loop fastener 31 at its inner and outer ends so that it may be secured to itself after being wrapped around the side rail 44. If bucket holder 10 is attached to the ladder where side rails 44 from both the base and extension sections of the ladder overlap, as shown in FIG. 2, strap 30 should be long enough to go around both side rails 44.

Referring now to FIG. 4, bucket holder 10 is shown attached to the top step 52 of a step ladder 50. Vertical grip portion 24 of handle 20 is inserted through one of the typical large holes 54 found in the top steps of step ladders for holding hammers and other tools. The horizontal stem 22 of handle spaces the frame 12 from the top step 52 sufficiently for a paint bucket B to be inserted through the frame. To prevent tilting or rocking of the frame and bucket, a stabilizer bracket 60 is mounted or formed on the outer side 12*b* of the support frame, facing the grip 20, with the bracket configured to engage the edge 53 of the top step 52. In the illustrated example, bracket 60 is an elongated L-shaped bracket with flat inner faces 62, 64 located below frame 12, and configured to engage the flat top and edge surfaces of top step 52.

It is also possible to form horizontal stem 22 in telescoping sections in order to adjust the effective length of the stem relative to frame 12, as best shown in FIG. 4. This may be done using a detent or locking pin mechanism 15*a* built into connecting stem portions 15 and/or 22*a* on the outer side 12*b* of frame 12. The length adjustment mechanism may be similar to that used for rung attachment fork 18 as shown in previous Figures, but with an axial adjustment of grip 20 toward and away from frame 12 via a longitudinally spaced row of detent pin holes in the handle stem 22*a* for selective engagement with pin 15*a*, thereby allowing a closer fit for stabilizer bracket 60 against the front edge of the step ladder top step 52, and/or to allow the vertical portion 24 of the handle to be mounted in holes 54 in top step 52 at different spacings from front edge 53.

FIG. 4 shows rung attachment fork 18 in phantom lines, and rotated at right angles to horizontally positioned support frame 12, to represent an optional vertical orientation useful for hanging tools or rags or other accessories from the fork while holder 10 is supporting paint bucket B at the top of the stepladder. Rung attachment fork 18 may be removably connected to frame 12, for example released by pressing the detent or removing the locking pin and pulling it free, where it is desired to reduce the distance of the stepladder and bucket B from an adjacent work surface.

Figure 5:
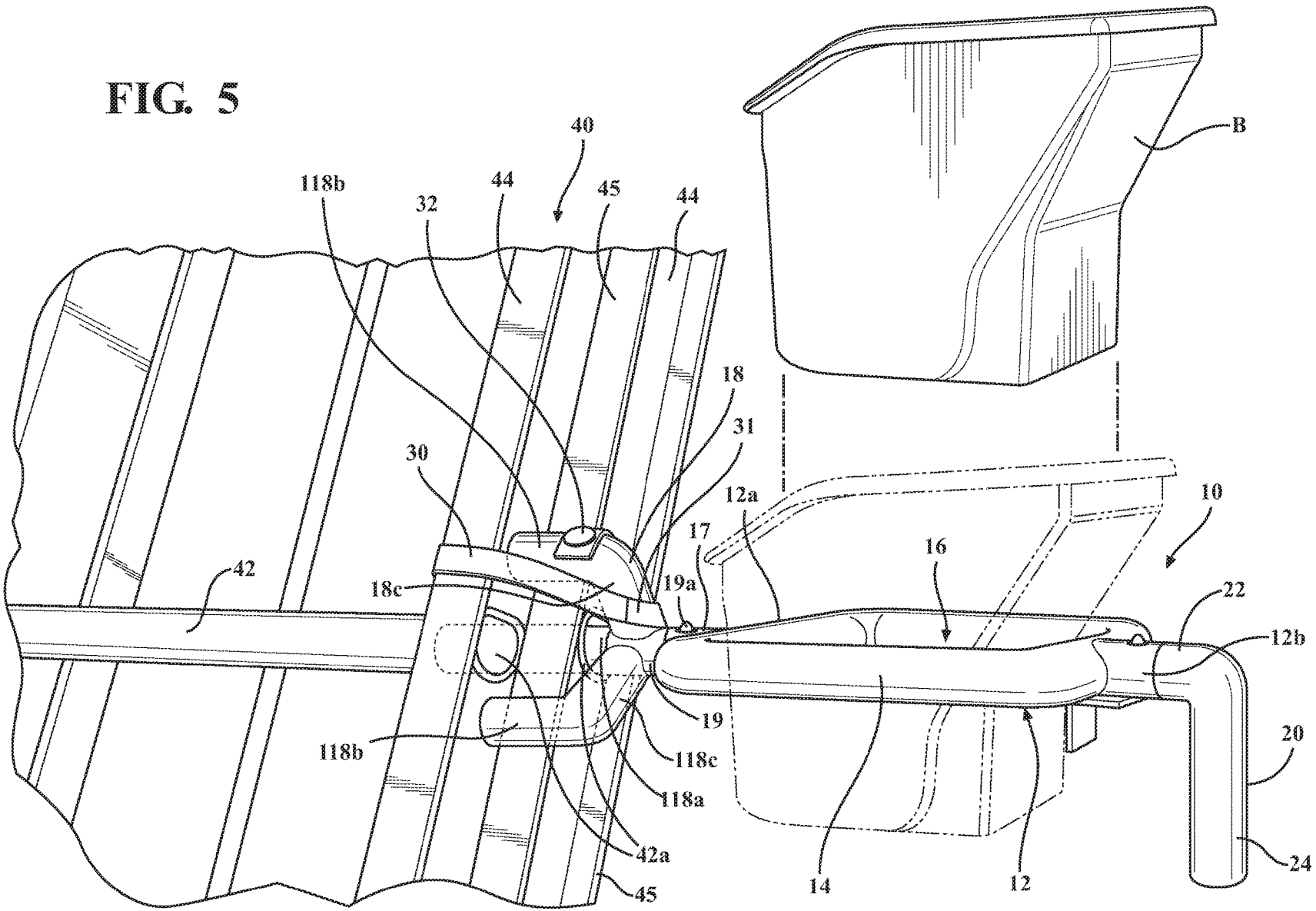
FIG. 5 is similar to FIG. 1, but shows a bucket holder according to the invention with a modified rung attachment fork.

FIG. 5 shows a modified rung attachment fork 118, with two outer prongs 118*b* aligned in a plane offset from the middle prong 18*a*. In the illustrated example, the outer prongs 118*b* are spaced from middle prong 18*a* by base portions 118*c* extending at right angles from the middle prong, as in FIGS. 1-3. However, one of the outer prongs 118*b* and its base 118*c* has been rotated approximately 90° degrees out of the planar fork configuration of FIGS. 1-3 to a triangular configuration as shown in FIG. 5. This triangular fork configuration allows both of the outer prongs 118*b* to simultaneously engage the same side (front-facing edge) of the ladder side rail 44 at spaced locations to prevent rotation of the fork (and of the attached bucket support 12) relative to the ladder. The length of the outer prongs 118*b* relative to middle prong 118*a* is the same as in the embodiment of FIGS. 1-3, for the same depth of engagement with the ladder side rail and rung.

Still referring to FIG. 5, if the outer prongs 118*b* are spaced from one another a distance equal to or greater than the front-to-rear width of ladder side rail 44 (with corresponding adjustment to the relative angle between the outer prongs), it would be possible to engage fork 118 with the ladder such that the outer prongs 118*b* bracket the front and rear edges 45 of the ladder rail, similar to the engagement of the outer prongs 18*b* with the front and rear edges 45 of the side rail in FIGS. 1-3.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A bucket holder configured for attachment to a ladder, the bucket holder comprising:

a horizontal bucket support, the bucket support comprising an inner side and an opposite outer side defining an opening between them configured to receive a bucket therethrough;

a three-pronged rung attachment fork extending laterally outward away from the inner side of the bucket support, the rung attachment fork comprising a longer middle prong and two generally L-shaped shorter outer prongs extending laterally outward in parallel away from the inner side of the bucket support, the outer prongs being radially spaced in parallel from the middle prong by base portions extending at right angles from the middle prong, the rung attachment fork being rotationally adjustable around a longitudinal axis of the middle prong relative to the bucket support between a plurality of rotationally locked positions to place the outer prongs in different planar positions relative to the opening of the bucket support, the middle prong extending laterally a first greater distance from the inner side of the bucket support, and the outer prongs extending laterally a second lesser distance from the inner side of the bucket support; and wherein, the base portions of the outer prongs are spaced laterally from the inner side of the bucket support.

2. The bucket holder of claim 1, wherein the outer prongs and the middle prong of the rung attachment fork are coplanar.

3. The bucket holder of claim 1, wherein the outer prongs of the rung attachment fork are in a plane offset from the middle prong.

4. The bucket holder of claim 1, wherein the horizontal bucket support comprises a frame defining a substantially enclosed ring surrounding an open interior configured to receive a paint bucket partway therethrough and to hold the inserted bucket securely.

5. The bucket holder of claim 1, further comprising a handle extending outwardly from the outer side of the bucket support, the handle including a grip portion spaced laterally and extending downwardly from the bucket support.

6. The bucket holder of claim 5, further comprising an L-shaped stabilizer bracket associated with the outer side of the bucket support between the bucket support and the grip portion, the L-shaped stabilizer bracket configured to engage an edge of a step ladder's top shelf or step to prevent rocking.

* * * * *